US006230899B1

(12) United States Patent
Hensley

(10) Patent No.: US 6,230,899 B1
(45) Date of Patent: May 15, 2001

(54) SINTERED CENTRIFUGE SEPARATION SYSTEM

(75) Inventor: Gary L. Hensley, Kingwood, TX (US)

(73) Assignee: Hutchison-Hayes International, Inc., Houston, TX (US)

( * ) Notice: Subject to any disclaimer, the term of this patent is extended or adjusted under 35 U.S.C. 154(b) by 0 days.

(21) Appl. No.: 09/234,796

(22) Filed: Jan. 20, 1999

(51) Int. Cl.[7] ..... B04B 1/08; B04B 1/12

(52) U.S. Cl. ..... 210/369; 210/377; 210/380.3; 494/36; 494/43; 494/60

(58) Field of Search ..... 210/360.1, 369, 210/377, 378, 379, 380.1, 380.3; 494/36, 43, 60

(56) References Cited

U.S. PATENT DOCUMENTS 2,750,040 * 6/1956 Strich ..... 210/371
3,269,028 * 8/1966 Strich ..... 210/380.3
4,135,659 * 1/1979 Derton et al. ..... 210/369
4,376,049 * 3/1983 Valentine ..... 210/380.3
4,518,621 * 5/1985 Alexander ..... 210/380.3
5,616,245 * 4/1997 Albrecht ..... 210/380.3

* cited by examiner

*Primary Examiner*—David A. Reifsnyder
(74) *Attorney, Agent, or Firm*—Felsman, Bradley, Vaden, Gunter & Dillon, L.L.P.

(57) ABSTRACT

A classification system utilizing a cone which is rotated at a specified speed is provided. A stream including a solvent is introduced into the classification, and the stream impacts against the cone and flows along the inside face of the cone. The side of the cone is sufficiently long that the conic face filters the introduced flow, thereby removing substantial portions of the solvent and leaving the heavier or classified parts. The discharge from the cone is thus segregated liquids and solids, and the solid stream is a flow of classified particles and a portion of the solvent. The solvent portion is sufficient in volume to conduct the classified particles as a heavy or thick slurry out of the system. There is an interplay between the length of the cone, i.e. the length along which the introduced slurry must flow, also, the cone angle, and the pores through the cone wall.

15 Claims, 2 Drawing Sheets

SINTERED CENTRIFUGE SEPARATION SYSTEM

BACKGROUND OF THE DISCLOSURE

In the manufacture of many products, it is necessary to make a separation between a solvent and classified particles carried in the solvent. This is also true for waste streams and the like. One example is the separation of cream from milk. Another example is the separation of valuable food products from excessive water. Dewatering can be often achieved by placing the liquid in a quite, stationary, still, settling pond or tank. However, when the volume is large, the tank has to be quite large and such sizes pose a serious problem.

The present disclosure is directed to a classification system and more specifically to a classification system utilizing a cone which is rotated at a specified speed. A stream is introduced, impacts against the cone and flows along the inside face of the cone. The side of the cone is sufficiently long that the conic face filters the introduced flow, thereby removing substantial portions of the solvent and leaving the heavier or classified parts. The discharge from the cone is thus described as segregated or classified liquids and solids, it being kept in mind that the solid stream is a flow of classified particles and a portion of the solvent. The solvent portion is sufficient in volume to conduct the classified particles as a heavy or thick slurry out of the system. There is an interplay between the length of the cone, i.e. the length along which the introduced slurry must flow, also, the cone angle, and the pores through the cone wall. Correlating these factors, the present disclosure sets out a relatively simple structure which can accomplish this sort of separation easily with a minimum amount of equipment. The present apparatus utilizes a controlled speed motor connected with a coupling and a drive shaft. That connects to the interior of a closed cabinet or housing of cylindrical shape. On the interior, the shaft connects with the cone and rotates the cone. The rotating cone imparts a centrifugal spin to the slurry introduced along the center line axis of the cone, being introduced through a centered pipe to a set of rotating vanes which impel the slurry to flow outwardly. As the slurry flows along the cone, segregation is accomplished, thereby classifying the larger particles which are oversized and cannot pass through the pores of the sintered cone. By appropriate deflection panels in the fixed housing around the cone, the solvent and solids flow downwardly and out through segregated discharge ports.

DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENTS

Figure 1:
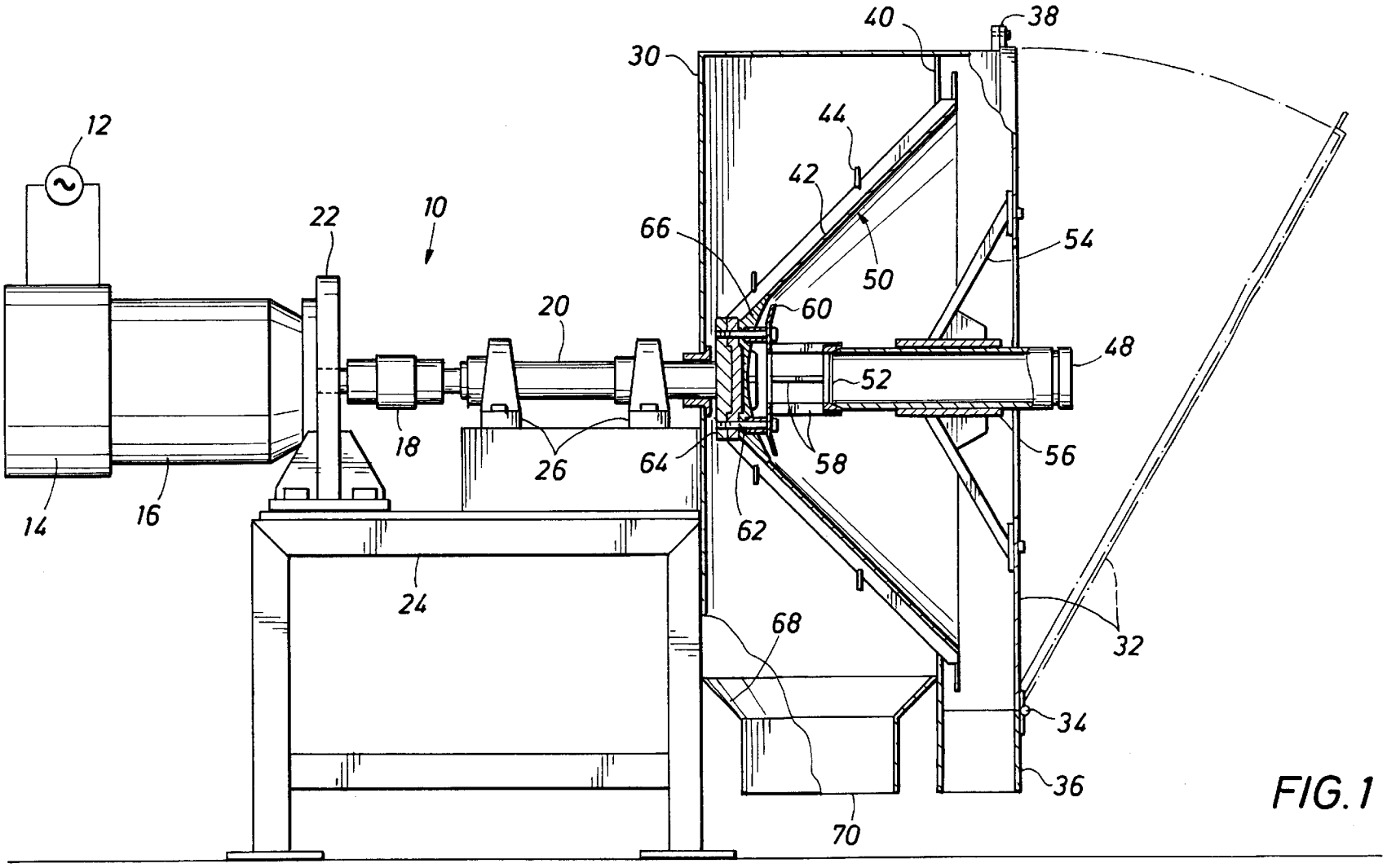
FIG. 1 is a side view of the sintered conic separator mechanism of the present disclosure connected with a motor and mounted in a housing and positioned to receive a flow to be separated from a feed pipe.
Figure 2:
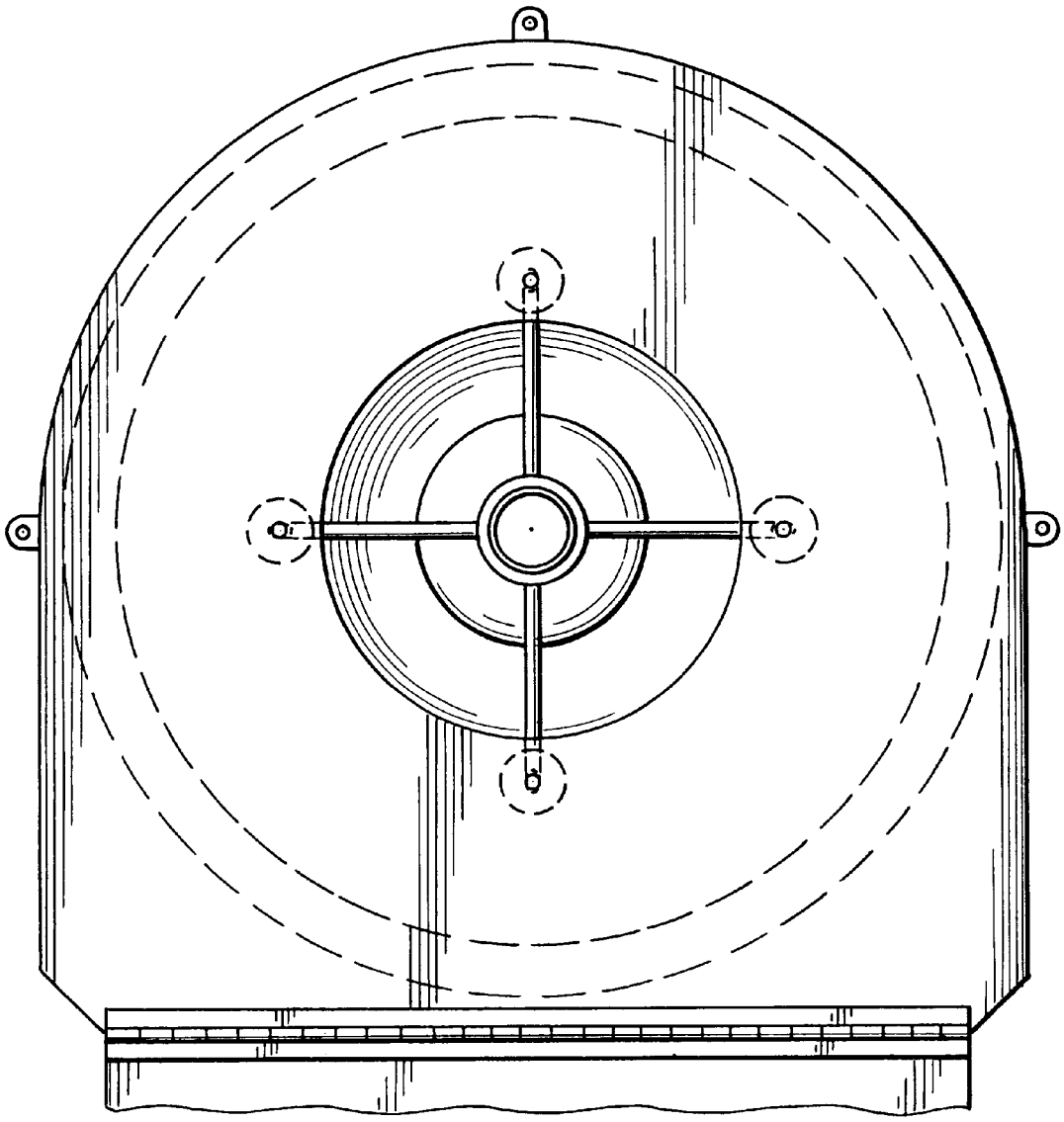
FIG. 2 is a end view of the cylindrical structure surrounding the cone shown in FIG. 1.

Attention is now directed to FIG. 1 of the drawings where the numeral 10 identifies the system in general, and operated for segregation of a feed. While the feed will be defined later, this description will begin with the power plant proceeding from left to right in FIG. 1. The numeral 12 identifies a power source which is adjustable. The power source preferably provides electric power which is adjustable either in frequency, current, or voltage. Power is furnished from the source to the motor 14. The motor 14 is rotated at a speed and in a direction subject to control of the power source. Typically, this device has the form of an adjustable control mechanism which adjusts as noted, thereby running the motor at a desired or designated power level. In turn, the motor 14 provides power output to a gearbox 16. The gearbox is connected to rotate a drive shaft 20. This is achieved through a coupling 18 which is axially aligned with the gearbox 16, and connects to the shaft 20.

The motor 14 is bolted to the gearbox 16, and the two are illustrated as having substantially a single structure with connection on the interior. Both of them are supported by an upstanding mounting bracket 22 which in turn is supported on a base or frame 24. The frame 24 is stationary and supports the upstanding alignment bracket 22. In addition, it supports first and second pillow blocks 26 which are aligned with the shaft 20. The pillow blocks typically provide both alignment and friction bearing systems. This enables the shaft 20 to extend to the right as shown in FIG. 1 and into a fixed or stationary cylindrical shell or housing 30. The housing is fixed, and comprises in the preferred embodiment an elongate cylindrical barrel or housing which is stationary. The housing 30 is joined to the frame 24 by suitable connection apparatus, and encloses the operative equipment. Focusing for the moment on the housing itself, it is constructed with a lid or cover 32 which cover is hinged at 34. The hinge 34 is appended to a downwardly directed discharge port 36. The lid 32 swings open to the dotted line position illustrated in FIG. 1. When closed, it is fastened with a bolt at the aligned tabs 38 at the top of the lid. The housing encloses a fixed internal ring 40 which connects with a set of angled reinforcing bars 42, and the bars 42 in turn connect with hoops 44 of differing diameter. They provide an open frame work or cage around the rotating cone 50. The cone 50 is rotated on the inside of this cage. More will be noted concerning the cone below. At this moment, it is appropriate to describe other equipment to the right so the feed of the material (to be classified) will be described.

The lid 32 on the cylindrical housing opens and closes. As noted, it supports a fixed feedline 48 which is input through the lid which terminates at a distal lip or edge 52. That is the discharge point for the tube 48. The feedline is maintained at right angles to the lid by a spider which includes the spider legs 54 connected with the sleeve 56. This assures appropriate alignment of the feedline 48. The feedline extends inwardly and almost contacts a facing set of vanes. In the preferred embodiment, there are four vanes 58 arranged in an X, and they all extend radially outwardly. The vanes confront a gap beyond the feedtube. With flow at any velocity out of the feedtube 48, the flow is forced into the gaps between the vanes. The vanes are collectively rotated as a unit thereby throwing the newly introduced slurry radially outwardly. The vanes are mounted on a saucer shaped disk 60, and the disk 60 in turn is held by several bolts 62 to a flange 64 for assembly purposes. The flange 64 is mounted to the shaft 20. Thus, the shaft 20 rotates the assembly just described at a specified speed.

The bolts 62 are assembly bolts which are used to clamp a central hub 66 which is positioned at the center or axial opening in the cone 50. The cone is preferably made of a different material. The cone is built to a specified sloping angle. The cone has a specified length from the center line axis out to the peripheral edge. The cone is made of sintered metal particles which are heated and caused to join together to form a unitary cone. By appropriate choice of the heating interval, choice of the particles, and control of other scale factors, pores are formed in the cone 50. Moreover, the pores can be controlled so that the cone has a desired liquid percolation rate, hence a selected molecular size. More specifically, scale factors in the cone itself include the length or height of the cone, the cone angle with respect to the axis of the shaft 20 and the wall thickness. Of great significance, the pores in the sintered cone significantly control processing. The pores are formed when the material is sintered. The size of the pores can be controlled down to 10 microns, 1 micron and even 0.1. At sizes in that range, the device then serves as a classification system. If for instance, water, hydrocarbon solvents such as benzene, MEK, and so on are involved, the liquid solvent will pass through pores of that size readily. It will segregate the components of the slurry which are larger than the pore size will pass. Since pore size is a scale factor than can be controlled, the device can be made to selectively segregate materials into two output streams. The introduced slurry is filtered through the cone 50 and flows outwardly to the outer wall of the cone. With adequate velocity, the droplets that collect on the outside of the cone are thrown radially outwardly whereby the droplets are captured in the housing 30. The housing is divided at the internal wall 40 previously mentioned, and the liquid flows downwardly into the bottom located funnel 68 and then into the discharge chute 70.

Operation of the device for a typical fluid will be given. Assume that a food processing plant forms a flow by crushing fruit. The pulp has value, but not necessarily for human consumption. For instance, the pulp in citrus fruits can be segregated and used in animal feed. A flow of the stream is introduced through the fixed feedpipe 48. As the flow is forced out of the end of the pipe, it engages the X shaped vanes and is thrown radially outwardly. It flows across the inside face of the cone. By spinning the cone at a relatively fast speed, gravity effects are nil, but centrifugal forces are quite significant. The very large centrifugal force applied to the droplets of citrus fruit keep flowing in the system. The crushed fruit will impinge and flow radially outwardly on the cone 50. Against the cone, separation is enhanced. This enhanced pressure results from the centrifugal forces. Each droplet tends to flow radially outwardly on the inside face of the cone while liquid solvent in the droplet will pass through the pores and out the back side of the cone. Pulp which is introduced with the liquid will flow eventually on the cone inside face and is directed radially outwardly to the right of the cone. The pulp, still somewhat moist with some of the solvent, will impinge on the inside face of the housing 30 and fall down through the solid discharge port 36. The system is operated continuously to form a discharge flow divided into two streams. For ease of description, one stream will be identified as the liquid or solvent. The other will be identified as the pulp (in the event of food processing) or solids in the event of other types of processing. The angle of the cone and the velocity of the cone are both important factors in controlling the separation accomplished. Without belaboring the point, such separation is highly controllable, depending on the scale factors which have been mentioned to this point.

One important aspect of control is speed. Another aspect is the radius to the outer lip of the cone. As the cone becomes smaller or larger, the cone changes the separation of the pulp so that it is wetter or drier. The cone is therefore rotated at a controllable speed. Another scale factor is the rate of introduction of liquid through the feed pipe. Another control factor is the fixed dimensions of the cone, i.e. angle of the cone, length of the cone side, and pore diameter of the cone. To provide a fairly rugged structure, this structure is well able to handle the separation described herein. The dwell time inside the cone is controlled in part by changing the speed of the cone rotation, the angle of the cone and the length of the cone. Also, it can be increased or decreased by changing the flow rate. Dwell time becomes a factor in achieving appropriate separation. As desired, the present apparatus can be used as a single separator for a slurry stream, or two of these devices can be connected serially with the same separation points or with different separation points, i.e. with different size pores, etc.

Representative Cone Construction

Scale factors involved in the cone should be noted. First, the cone angle is ideally between about 20° and 30°, and the optimum appears to be around 25° or 26°. Angles less than 20° involve an excessively long or tall conic construction, and one which is inclined to excessive drying of the particles. Angles greater than about 30° are undesirable in general terms because the dwell time of an individual droplet on the inside face of the cone is reduced excessively. The first point of liquid impingement when the slurry in introduced is not at the apex of the cone; rather, it is deflected radially outwardly as the slurry flows into the vanes 58 and is thrown against the cone. It will typically strike the cone at some distance from the apex. For that reason, the tip or point of the cone which is covered by the hub 66 need not be permeable material; the pores are formed beyond the hub 66 in the cone 50. The point of impingement of the introduced stream defines the minimum diameter, and in that region, the slurry is exposed to the minimal centrifugal force. Typically, this will involve a cone radius of 6 to 10 inches. Preferably, the outer lip is constructed to have a radius of about 2:1 up to about 3:1 greater so that there is a centrifugal force difference of two fold or three fold depending on the radius. For practical reasons, a maximum diameter of the cone of about 36 to about 42 inches is suggested. While they can be made larger, the rotating mass increases, and just as readily, the centrifugal forces at the outer edge of the cone increase in a way that causes excessive drying.

The pore size can be anywhere from about 20 microns and down utilizing a sintered metal construction. If desired, the cone 50 can be formed of solid metal and drilled with the smallest drill available. This, however, is less desirable. The preferred form is the sintered cone construction because the number of pores can be increased and the aggregate cross sectional area of the pores is acceptable. By contrast, to get an adequate cross sectional area utilizing drilled holes, the holes are somewhat large and the success in filtration is reduced because the holes are on the large side. While such a drilled cone construction will suffice in rare circumstances, the preferred form of the present device utilizes the sintered cone.

The speed provided for the motor 14 operating through the gearbox to rotate the cone should be adjustable so that the droplets are provided with a desired maximum centrifugal force. Speed can be correlated to centrifugal forces once the physical dimensions of the cone are established. In some instances, it will be necessary to increase the speed, and in other instances it would be helpful to decrease the speed; in both instances, changes in the centrifugal force are implemented.

While the foregoing is directed to preferred embodiment, the scope thereof is determined by the claims which follow:

What is claimed is:

1. A centrifuge for receiving a feed flow and separating solids and liquids in the feed flow, the centrifuge comprising:

(a) a tapered porous cone formed of sintered materials having an inside face on a porous wall extending outwardly to a peripheral edge wherein the cone defines an axis of rotation, a specified conic angle and cone length;

(b) a power drive operatively connected to the cone to rotate the cone about the axis;

(c) a closed housing surrounding said cone and having a fixed internal ring secured to the housing arranged to divide the feed flow introduced into the cone into a solvent flow passing through the wall of the cone, and a solid flow which does not pass through the wall of the cone but which is discharged over the peripheral edge;

(d) an inlet line for delivering a flow of solvent with solids into the cone to impinge on the face of the cone; and (e) a plurality of radially outwardly oriented vanes mounted on said cone at the inside face thereof so that said vanes intercept the flow from the tube to deflect the flow radially outwardly onto the inside face of the cone.

2. The apparatus of claim 1 wherein said cone has a conic angle of about 20° to about 30°, and has an outer peripheral edge having a radius up to about 42 inches.

3. The apparatus of claim 1 wherein said cone defines serpentine flow paths therethrough wherein said flow paths have a specified maximum diameter.

4. The apparatus of claim 1 wherein said cone has a wall thickness of specified thickness, and said power drive operatively connected to the cone by a drive shaft for rotation about the axis of said cone, and said cone comprises a sintered metal particle construction forming a solid metal member having pores therethrough.

5. The apparatus of claim 4 wherein the cone supports an internal flow deflector.

6. The apparatus of claim 1 wherein said power drive includes a motor connected with a gearbox and the gearbox is connected to a drive shaft for rotation of said cone.

7. The apparatus of claim 6 wherein said motor is connected with a power source, and is controllable to vary the speed of the motor.

8. The apparatus of claim 1 wherein said housing comprises an elongated, fixed, solid, cylindrical spaced wall about said cone, and said housing terminates at an end located planar lid mounted to be opened or closed to obtain access to the interior of said housing.

9. The apparatus of claim 8 wherein said lid supports said inlet line and said inlet line extends into said housing to be positioned on the interior of said cone.

10. The apparatus of claim 9 wherein said inlet comprises a fixed nonrotating inlet line which is positioned with an outlet discharge end located on the interior of said cone, and said end is spaced from a flow directing vane for diverting flow to rotate on the inside face of the cone.

11. The apparatus of claim 1 wherein said inlet comprises:

(a) a fixed, straight tube having an outside end to receive a flow of solvents with solids and an inside end to direct the flow onto the cone;

(b) a transverse support spider connected to said tube;

(c) laterally extending spider legs to stabilize said tube at a fixed location with respect to said housing to position said tube inside end in said cone;

(d) the vanes; and (e) a circular disc supporting said vanes to enable said vanes to direct the flow against said cone inside face.

12. The apparatus of claim 11 wherein said vane and disc cooperate to deflect the flow onto a cone inner face region having a radius of more than about 6 inches.

13. The apparatus of claim 12 wherein cone inner face region defines a radius of up to about 21 inches.

14. The apparatus of claim 12 wherein the cone has a conic angle of about 20° to about 30°.

15. The apparatus of claim 12 wherein said cone is formed with randomly distributed perforations comprising pores through said wall and said pores are smaller than about one micron.

* * * * *